United States Patent [19]

Klusmier et al.

[11] Patent Number: 4,831,828

[45] Date of Patent: May 23, 1989

[54] CRYOGENIC REFRIGERATOR HAVING A CONVECTION SYSTEM TO COOL A HERMETIC COMPRESSOR

[75] Inventors: Lawrence A. Klusmier, Chelmsford; Hans T. Clarke, Hudson; Gary Gatto, Holden, all of Mass.

[73] Assignee: Helix Technology Corporation, Waltham, Mass.

[21] Appl. No.: 54,935

[22] Filed: May 27, 1987

[51] Int. Cl.[4] ..... F25B 9/00

[52] U.S. Cl. ..... 62/6; 62/505; 92/144; 165/185; 310/64; 417/366

[58] Field of Search ..... 62/505, 6; 417/366; 165/185; 92/144; 310/52, 54, 64, 57, 87, 89, 91

[56] References Cited

U.S. PATENT DOCUMENTS

| | | | |
|---|---|---|---|
| 2,426,536 | 8/1947 | Vanderweil | 165/182 |
| 2,737,370 | 3/1963 | Frisch et al. | 165/182 |
| 3,089,016 | 5/1963 | Kelly | 165/182 |
| 3,143,284 | 8/1964 | Lindsjo et al. | 417/363 |
| 3,300,997 | 1/1967 | Kocher | 62/505 |
| 3,719,051 | 3/1973 | Malaker | 62/6 |
| 4,103,192 | 7/1978 | Wendt et al. | 310/91 |
| 4,192,052 | 3/1980 | MacDonald | 165/182 |
| 4,244,098 | 1/1981 | Barcus | 310/64 |
| 4,248,050 | 2/1981 | Durenec | 62/6 |
| 4,253,859 | 3/1981 | Naka | 62/6 |
| 4,433,550 | 2/1984 | Durenec | 62/6 |
| 4,481,777 | 11/1984 | Sarcia | 62/6 |
| 4,574,591 | 3/1986 | Bertsch | 62/6 |

FOREIGN PATENT DOCUMENTS 534600 12/1956 Canada .

OTHER PUBLICATIONS

Description of product of Grinnell Supply Sales Co. utilizing cooling fins.

Description of product of Young Radiator Co. utilizing cooling fins.

Description of product of Noranda Metal Industries utilizing cooling fins.

Description of product of Unifin International Div. utilizing cooling fins.

*Primary Examiner*—Ronald C. Capossela

*Attorney, Agent, or Firm*—Hamilton, Brook, Smith & Reynolds

[57] ABSTRACT

In accordance with the invention, a hermetic refrigerant compressor pump which is used to compress helium is cooled by fins which are press fitted to the compressor's housing. The compressor is further cooled by a heat exchanger which cools oil in an oil sump located within the compressor housing. Preferably, a fan is located between the fins and the heat exchanger to help cool the pump.

9 Claims, 3 Drawing Sheets

CRYOGENIC REFRIGERATOR HAVING A CONVECTION SYSTEM TO COOL A HERMETIC COMPRESSOR

BACKGROUND

This invention pertains generally to the cooling of a hermetic compressor pump used in cryogenic refrigeration. During operation, the pump compresses a mixture of oil and helium. The purpose of the oil is to absorb the heat produced in compressing helium and to provide lubrication to the pump. From the compressor, the mixture exits a feed line in which the oil is separated from the mixture. Conventional methods use an oil separator and then an oil adsorber to filter the oil out of the mixture. Once separated, the gas is then pumped to the cold head of a cryogenic refrigerator such as a Gifford-MacMahon cryogenic refrigerator disclosed in U.S. Pat. No. 3,218,815 to Chellis et al. After traveling through the refrigerator, the gas is returned to the compressor through a return line to start the process over again.

As a result of compressing helium, rather than freon which is used in other refrigeration systems, more heat is produced by the compressor pump. In order to maintain operating efficiency and prolong the life of the pump, this heat by-product must be removed.

DISCLOSURE OF THE INVENTION

In accordance with the invention, a hermetic refrigerant compressor pump which is used to compress helium is cooled by fins which are press fitted on to the compressor's housing. Preferably, each fin comprises a cylindrical blade surface and a flange bent away from the blade surface for engagement with the housing. By tapering the flange toward the axial center of the fin, heat conducted from the housing to the blade surface can be maximized.

The compressor is further cooled by an external heat exchanger which cools oil from an oil sump located within the compressor housing. Suction created by the compressor pump provides the mechanism for pumping oil from the sump, through the heat exchanger, before the oil is mixed with helium.

Preferably, there is a fan placed adjacent to the fins and the heat exchanger for directing a flow of air past the fins and the exchanger. Further, it is preferred that there is a means for separating oil from the compressed helium before it is used in a cryogenic refrigeration system.

BRIEF DESCRIPTION OF THE DRAWINGS

The foregoing and other objects, features and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
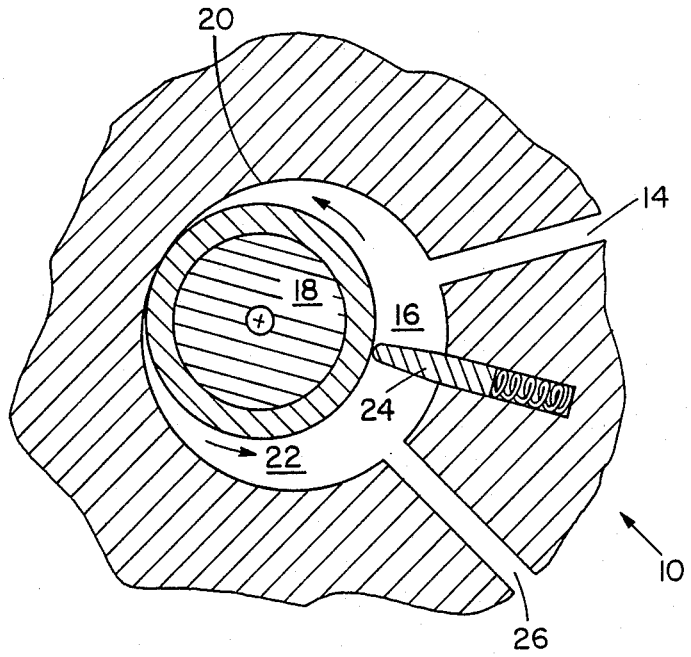
FIG. 1 is an illustration of a partial cross section of a compressor pump.

The present invention relates to a cryogenic refrigeration system which has a compressor pump cooled by a convection system. A partial cross section of a typical compressor pump 10 is shown in FIG. 1. The compressor pump 10 draws a helium gas and oil mixture through an inlet port 14 to a suction chamber 16 which is created as a rolling piston 18 rotates around a cylinder 20. The mixture is then compressed in a compression chamber 22 as the piston 18 makes a complete revolution around the cylinder 20. Simultaneously, more of the mixture is drawn into the suction chamber 16. A vane 24 which is biased to remain in contact with the rolling piston 18 defines the suction chamber 16 and the compression chamber 22. The compressed mixture is exhausted out an exhaust port 26.

Figure 2:
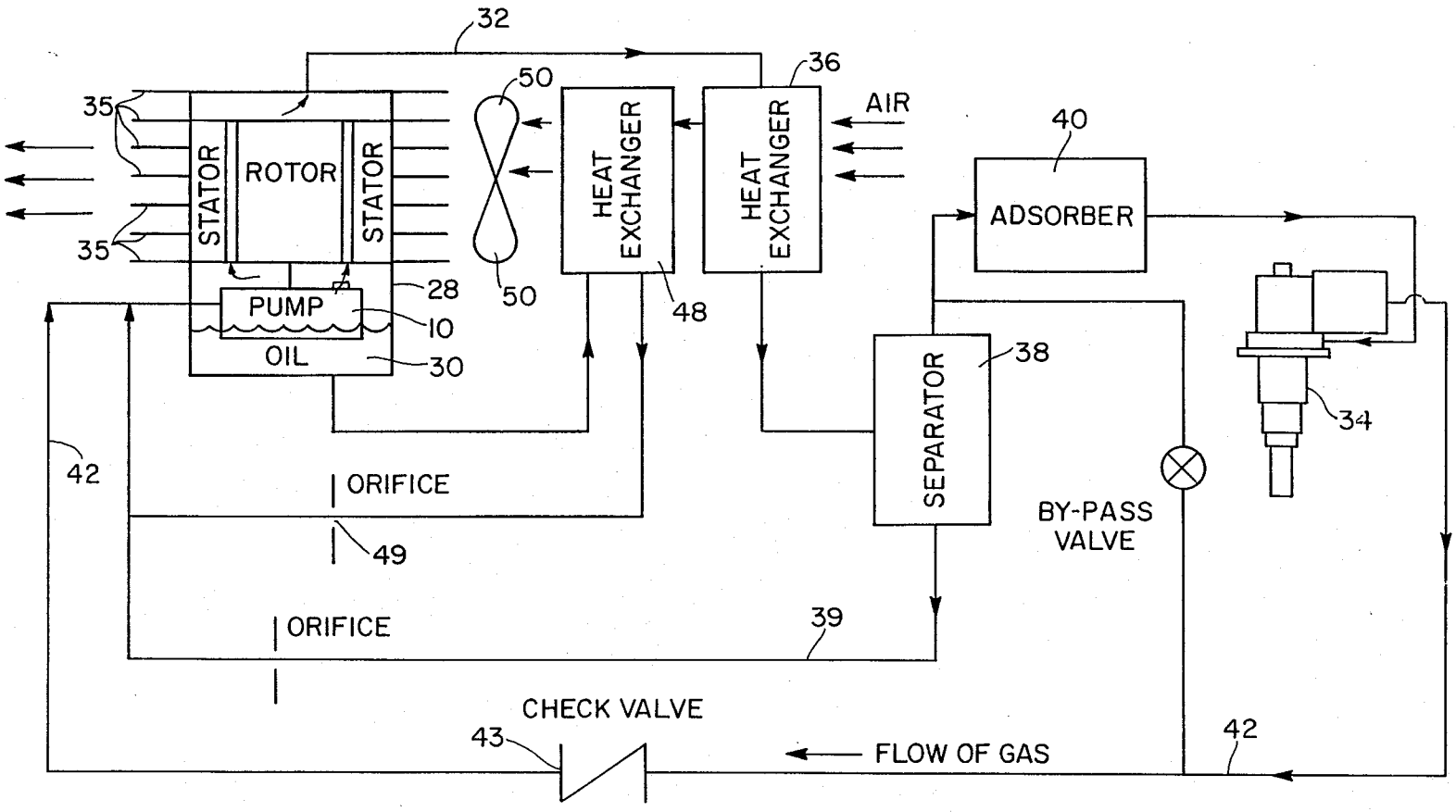
FIG. 2 is a schematic illustration of a compressor system embodying the invention.

The compressor pump 10 is located within a compressor housing 28, as shown in FIG. 2. As the compressed mixture is exhausted from the pump 10 into the housing 28, the bulk of the oil separates from the compressed gas and collects at an oil sump 30. The compressed gas is then fed into a feed line 32 for work in a cryogenic refrigerator 34 such as a Gifford-MacMahon cryogenic refrigerator. To further prepare the compressed gas for work it is preferred that the gas is cooled by a heat exchanger 36 and further filtered from oil by an oil seperator 38 and an absorber 40. The ordering of the filtering and cooling may be interchanged. Oil separated by the oil separator 38 may be returned to the pump 10 through a suction line 39.

Once the gas has performed work in the refrigerator 34, it is returned to the pump by a return line 42 connected to the inlet port 14. Preferrably, a check valve 43 has been placed along the return line 42 to prevent the flow of gas from back flowing to the refrigerator 34.

During operation of the refrigeration system, a considerable amount of heat is generated by the pump. In order to maintain operating efficiency and prolong the life of the pump, the compressor must be cooled. In accordance with the present invention, a series of fins 35 which serve as heat exchangers are press fitted to the housing of the hermetic compressor. Additionally, oil in the sump 30 is cooled by circulating it through an external heat exchanger 48.

Figure 3:
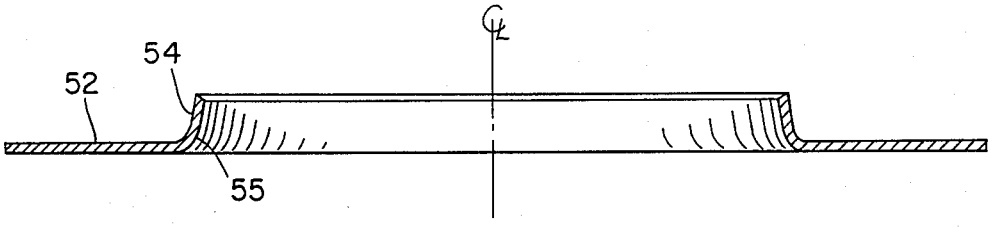
FIG. 3 is a cross section of a fin.
Figure 4:
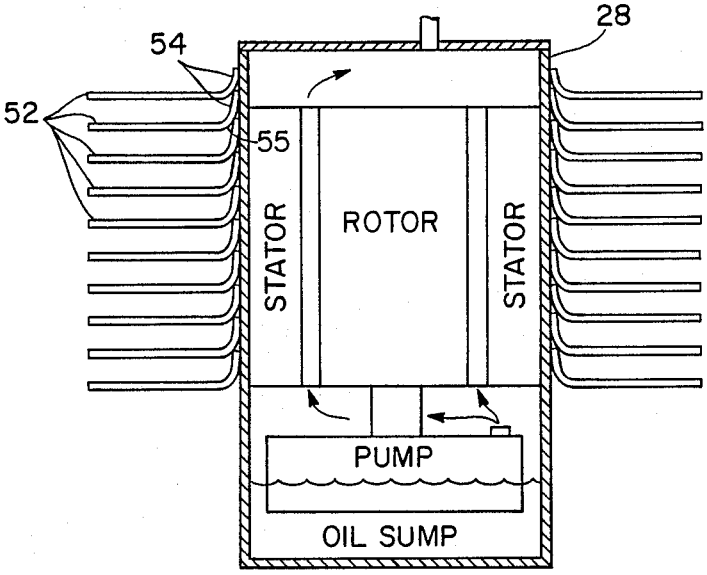
FIG. 4 is an illustration of a compressor pump having a plurality of fins press fitted to the compressor's housing.

As shown in FIG. 3, each fin 35 comprises a circular blade surface 52 and a center flange 54 bent away from the blade surface 52. Preferably, the fin 35 is made of a highly conductive material such as aluminum. To optimize the surface area in contact with the wall of the housing 28 and thereby maximize the amount of heat conducted to the fin, the flange 54 is inwardly tapered towards the axial center of the fin. When the fin is pressed onto the housing, the resiliance of the flange operates as a force to maximize the surface area in contact with the wall of the housing. The resiliance force also operates as a lock to prevent the fin from moving once it has been placed on the housing. Further, contact between the housing and the fins 35 can be increased by wedging the flange 54 between a curved portion 55 of another fin and the wall of the housing 28 as shown in FIG. 4. Wedging the flange in this manner also helps lock the fin in place along the housing.

Referring back to FIG. 2, the compressor is also cooled by pumping oil from the oil sump 30 through an external heat exchanger 48. Oil cooled by this heat exchanger 48 is then returned to the pump 10 through an orifice 49. Suction created by the pump 10 serves as the mechanism used to pump the oil through this heat exchanger 48 as well as from the separator 38 and to pump gas from the refrigerator 34.

Situated between the heat exchangers 36 and 48 and the fins 35 on the housing is a fan 50. During operation, the fan 50 directs a flow of air past the heat exchangers 36 and 48 and the fins 35 to increase the cooling rate of the overall compressor system.

While this invention has been particularly shown and described with reference to preferred embodiments thereof, it will be understood by those skilled in the art that various changes in form and details may be made without departing from the spirit and scope of the invention as defined in the appended claims. For example, gases other than helium may be used. Further, a pressure valve may be used between the feed line and the return line to regulate the presssure of the system.

I claim:

1. A cryogenic refrigeration system having a compressor for compressing helium gas comprising:

a compressor housing;

an oil sump located within the compressor housing;

a plurality of fins secured to the compressor housing by press fitting each fin such that the fins are wedged against the housing by adjacent fins; and a fan for cooling the compressor housing by creating a flow of air which passes over the fins.

2. A cryogenic refrigeration system having a compressor for compressing helium gas as claimed in claim 1, wherein each fin comprises a blade surface and a center flange portion formed along the inner portion of the blade surface.

3. A cryogenic refrigeration system having a compressor for compressing helium gas as claimed in claim 1 further comprising a heat exchanger external to the compressor housing for cooling oil in the oil sump.

4. A cryogenic refrigeration system having a compressor for compressing helium gas as claimed in claim 3 wherein the fan cools the heat exchanger.

5. A cryogenic refrigeration system having a compressor for compressing helium gas as claimed in claim 1 further comprising a filter means for filtering oil from the compressed helium gas before using the gas to perform work.

6. A compressor pump for compressing gas comprising:

an oil sump located within the compressor;

means for pumping oil from the oil sump and the gas through a rotor assembly to compress the gas, and then return the oil to the oil sump; and a plurality of fins secured to the compressor, wherein each fin comprises a blade surface and a flange bent away from the blade surface for engagement with the compressor.

7. A compressor pump for compressing gas as claimed in claim 6 further comprising a fan for directing air past the heat exchanger and the fins.

8. A compressor pump for compressing gas as claimed in claim 6 further comprising a filter means for filtering oil from the compressed gas before using the gas to perform work.

9. A compressor pump for compressing gas as claimed in claim 6 wherein said flange resiliently engages the compressor housing.

* * * * *